United States Patent [19]

Heckethorn

[11] Patent Number: 4,665,378

[45] Date of Patent: May 12, 1987

[54] MOTOR VEHICLE GARAGING SAFETY METHODS, AND APPARATUS AND SYSTEMS

[75] Inventor: John E. Heckethorn, Dyersburg, Tenn.

[73] Assignee: 3900 Corp., Baltimore, Md.

[21] Appl. No.: 742,788

[22] Filed: Jun. 10, 1985

[51] Int. Cl.[4] ..... G08G 1/14

[52] U.S. Cl. ..... 340/51; 340/52 H; 340/988; 340/958; 340/686; 250/491.1; 49/25; 49/31

[58] Field of Search ..... 340/51, 50, 52 H, 61, 340/951, 947, 953, 954, 982, 985, 933, 988, 942, 686, 52 R, 958, 555, 556; 250/491.1, 222.1, 561; 180/168; 350/622; 49/25, 26, 31

[56] References Cited

U.S. PATENT DOCUMENTS

| | | | |
|---|---|---|---|
| 2,221,449 | 11/1940 | Hoeninghausen | 350/622 |
| 2,569,576 | 10/1951 | Ramme | 350/622 |
| 2,645,159 | 7/1953 | Darroch | 350/622 |
| 2,750,583 | 6/1956 | McCullough | 340/686 |
| 3,662,332 | 5/1972 | Zechnowitz et al. | 340/51 |
| 4,015,235 | 3/1977 | Demaine et al. | 340/51 |
| 4,311,983 | 1/1982 | Piper | 340/51 |

FOREIGN PATENT DOCUMENTS

| | | | |
|---|---|---|---|
| 3340687 | 5/1985 | Fed. Rep. of Germany | 340/51 |
| 0857151 | 8/1981 | U.S.S.R. | 340/51 |

*Primary Examiner*—Donnie L. Crosland

*Attorney, Agent, or Firm*—Dennison, Merserole, Pollack & Scheiner

[57] ABSTRACT

A signal light is projected in a concentrated beam downwardly when a garage door is fully opened to provide a light spot on the garage floor where no vehicle obstructs it and on the vehicle, such as on the dashboard thereof, when a vehicle is at a properly parked position in the garage. This provides signals both that the door is fully open, indicating that it is safe to exit or enter the garage as well as that the vehicle is in the proper position for parking. In addition, the light source itself may be arranged to glow visibly to an operator outside the garage as a further indication that it is safe to enter. Adjustable bracket means enables the location of the signaling lamp and signal-like spots to be adjusted. The light source is controlled by the position of the garage door, so as to only be illuminated when the door is fully opened. The signal lamp may be controlled by a separate normally open switch closed by the garage door when in the fully opened position thereof or may be tied into and controlled by the circuitry of the garage door operator and by the conventional limit switches, which may be modified, if necessary, to provide a normally-open contact pair for full open position of the door.

5 Claims, 4 Drawing Figures

MOTOR VEHICLE GARAGING SAFETY METHODS, AND APPARATUS AND SYSTEMS

FIELD OF THE INVENTION

This invention relates to methods, apparatus and systems for improving garaging safety of motor vehicles such as automobiles, and the like, and more particularly, to methods, apparatus and systems for signaling and indicating to the operator of such a motor vehicle, such as an automobile, or the like, both the position of an automobile within such garage and the position of the door or doors thereof so that such motor vehicle may be safely driven into or out of a garage without inadvertent and potentially damaging contact between the vehicle and the door or doors or the wall of the garage opposite thereto.

BACKGROUND OF THE INVENTION

In the garaging or parking of an automobile or other motor vehicle in a garage a problem has always existed for operators in gauging how far to drive the vehicle into the garage to a properly parked position. If the vehicle is not pulled sufficiently far into the garage it may not be possible to close the door or doors of the garage. On the other hand, if the vehicle is pulled sufficiently far into the garage that operation of the door or doors is assured, it sometimes occurs that the operator may misjudge the distance to a wall or other obstacle opposite or spaced from the door or doors defining the proper parking position for the vehicle.

Various methods, apparatus and systems have been suggested for gauging the proper position at which to stop a vehicle after entering a garage without hitting the wall thereof opposite the door. Such wall is often referred to in the literature as the "rear" wall of the garage, which designation has no reference to the direction in which the vehicle is headed. Generally, it is easier for most operators to park a motor vehicle by driving forwardly into the garage and then backing the vehicle rearwardly out of the garage when it is desired to leave, although some operators prefer to back into the garage and exit therefrom forwardly.

The "front wall" as used herein, however, is intended to identify merely a location beyond which it is not desirable that the vehicle attempt to go, spaced from the door or doors. For example, it may define a location beyond which other items or vehicles may be stored or parked. Moreover, as used herein it is not material whether the vehicle is driven forwardly into the garage and rearwardly outwardly thereof or is backed into the garage and driven forwardly away from the "front wall".

In the case of power-operated garage doors, with which the operator may remain in the vehicle during door operation or movement, an additional hazard exists. The operator may strike the door with the vehicle if he attempts to drive either in or out of the garage before the door is fully opened. This is especially problematical when the vehicle is backed either into or out of such garage as the vehicle roof in either case may obstruct the operator's view of the door. Applicant is not aware of any provision of a specific signal provided when the door is fully opened, other than the possible incidental sound of the drive mechanism. Area lighting controlled by the door-opening system generally operates from the start of motor operation to a timed subsequent duration to enable the driver time to exit the garage.

In Traub, U.S. Pat. No. 2,454,896 it is suggested that a rod 40 suspended from a battery powered light unit may be utilized as a contact switch to be contacted, for example, by the vehicle front bumper when the vehicle has entered the garage a desired distance. At such time, the light is flashed as a signal. It is not certain whether such signal would be useful in backing a vehicle into the garage. Such rod would be an obstruction to walking or working in front of the vehicle and has no connection whatsoever to the garage door and does not signal the operator when it is safe to drive in or out of the garage.

In Seith et al, U.S. Pat. No. 2,991,406, it is suggested to provide a light connected to a garage door operator. It is lit when the door is moving and for 90 seconds thereafter and is for general illumination purposes only. It gives no indication of when the door is fully open.

Williams, U.S. Pat. No. 3,219,972, suggests another battery powered light device similar to the device of Traub discussed above. The light is also flashed or first energized and then de-energized as the vehicle moves into final parking position. There is no indication or signal of when the door is fully opened to back out and, like Traub, the Williams device would be an obstruction in the garage. Further, if mounted on the front wall as taught by Williams, it would not permit space to walk in front of the vehicle or to work under the hood after it was parked. It is again not clear whether the Williams device would be useful when backing into the garage.

Insofar as relevant to the present invention, Brancale, U.S. Pat. No. 3,493,925 teaches the use of a magnetic proximity switch mounted to the front wall of the garage to light a signal lamp as the vehicle approaches closely to such front wall or to a pylon upon which the magnetic proximity detector is mounted. Since close proximity is required, either the front wall or such pylon would be an obstruction to walking or working in the front of the vehicle. Further, Brancale does not suggest when it is safe to exit the garage.

Brauer, U.S. Pat. No. 3,817,203, suggests a ball-like indicator lowered into a position to be visible from the driver position of a vehicle entering or properly parked in a garage and which moves in conjunction with the garage door. When the door is open, the indicator is in a lowered position and when the door is closed the string is retracted. In warm weather if the garage door was left open, the ball would be an obstacle when walking inside the empty garage. Moreover, to indicate that the door is fully opened, the operator must observe that the ball has stopped, which requires a subjective evaluation by the operator. Moreover, the Brauer device is also of questionable utility where it is desired to back the vehicle into the garage.

OBJECTS OF THE INVENTION

It is therefor a primary object of the present invention to provide new and improved means, methods, apparatus and systems for indicating to a vehicle operator positively and objectively both when a vehicle has reached a proper parking position within a garage and whether the door or doors thereof are fully opened indicating that it is safe to exit the garage.

It is another primary object of the present invention, to provide such methods, means, apparatus and systems which avoid any physical contact whatsoever with the vehicle and which does not present an obstruction in the garage area.

It is yet another primary object of the present invention, in addition to each of the foregoing objects, to provide such novel methods, means, apparatus and systems which are automatic in operation.

It is a yet further primary object of the present invention, in addition to each of the foregoing objects, to provide such methods, means, apparatus and systems which are independent of the front wall of the garage so as not to require close proximity of the vehicle to such front wall and which enables marking of a parking location spaced therefrom to define a storage or work space.

Yet still another primary object of the present invention, in addition to each of the foregoing objects, is the provision of such methods, means, apparatus and systems of utility whether the vehicle is to be driven forwardly or rearwardly into the garage.

It is a yet still further primary object of the present invention, in addition to each of the foregoing objects, to provide a visual signal to the operator of the vehicle when it is safe to move a vehicle into or out of a garage.

Another and yet further primary object of the present invention, in addition to each of the foregoing objects, is to provide an inexpensive and foolproof signaling system which may be easily adapted to automatic garage door operators, particularly those with remote actuating controls.

Yet another and still further primary object of the present invention, in addition to each of the foregoing objects, is the provision of methods, means, apparatus and systems for projecting an illuminated image, such as a bright spot of light onto the dashboard or other location visible to the operator of a vehicle when such vehicle is parked at a proper location within a garage and the door thereof is fully open.

BRIEF SUMMARY OF THE INVENTION

A signal light is projected in a concentrated beam downwardly when a garage door is fully opened to provide a light spot on the garage floor where no vehicle obstructs it and on the vehicle, such as on the dashboard thereof, when a vehicle is at a properly parked position in the garage. This provides signals both that the door is fully open, indicating that it is safe to exit or enter the garage as well as that the vehicle is in the proper position for parking. In addition, the light source itself may be arranged to glow visibly to an operator outside the garage as a further indication that it is safe to enter. Adjustable bracket means enables the location of the signaling lamp and signallike spots to be adjusted. The light source is controlled by the position of the garage door, so as to only be illuminated when the door is fully opened. The signal lamp may be controlled by a separate normally-open switch closed by the garage door when in the fully opened position thereof or may be tied into and controlled by the circuitry of an automatic garage door operator or to the conventional limit switches provided and used therewith, which may be modified, if necessary, to provide a normally-open contact pair for full open position of the door.

DETAILED DESCRIPTION OF THE INVENTION

Figure 1:
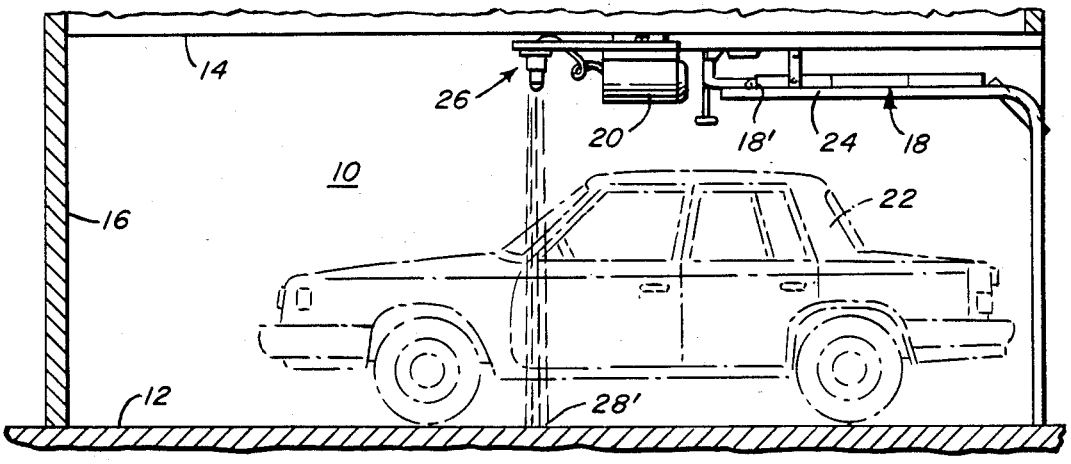
FIG. 1 is a schematic illustration of a garage, having a door opening indication and vehicle garaging parking safety apparatus, method, means and system in accordance with the present invention.

With reference now to the drawings, particularly to FIG. 1 thereof, there is shown and illustrated a device for enabling motor vehicles, such as automobiles, to be parked at a desired location, such as in a garage, or the like, and adapted to provide a safety indication to the vehicle operator both that the motor vehicle has reached the desired location or that the garage door is in a fully opened position indicating that it is safe to move the motor vehicle into or out of the garage.

Automotive garages are often provided with automatic garage door operators, primarily to operate overhead doors although automatic operators for swinging doors are also available. It is highly desirable for the operator of a vehicle parked in such a garage and contemplating exiting the vehicle therefrom or contemplating driving into such garage to wait until the door or doors are fully open to avoid damage to the door or doors or to the motor vehicle.

As pointed out in the background of the invention, various devices have been heretofore suggested for indicating to the operator of such a vehicle upon entering a garage when the vehicle has sufficiently entered the garage as to enable the door or doors to be closed without impinging upon the vehicle while yet avoiding impingement of the vehicle upon the front wall of the garage or encroachment upon a clear space or storage space allocated within the garage forwardly of the desired parking location. Such prior art devices as are known to Applicant, however, are notably deficient as pointed out above.

With reference now to FIG. 1 there is shown and illustrated improved methods, means, apparatus and systems comprising a garage designated generally by the reference character 10 having a floor 12, a ceiling 14, a front wall 16 and an overhead garage door 18 which may be operated, that is, opened and closed by means of an automatic garage door operator 20. A motor vehicle, such as an automobile 22 can be conveniently parked within the garage 10. The overhead garage door 18 may, in accordance with conventional practice ride along tracks 24 extending on either side of the door opening and extending subjacent the ceiling 14. In accordance with the present invention, there is also provided means for projecting an illuminated image, such as an indicator or signaling device 26 effective to project a beam of light 28 downwardly to provide a light spot image upon a target such as the dashboard of the vehicle 22 when the vehicle has reached the desired parking location within the garage 10. The projected image may be a generally circular spot or other image, such as an appropriate word or symbol. The indicating or signaling device 26 may be physically associated with the door operator or may be separately mounted on or suspended from the ceiling 14. The device 26 may also be electrically associated with the door operator 20 or may be separately controlled, although for convenience and simplicity of operation is preferably electrically associated therewith, as will be pointed out hereinafter.

Figure 2:
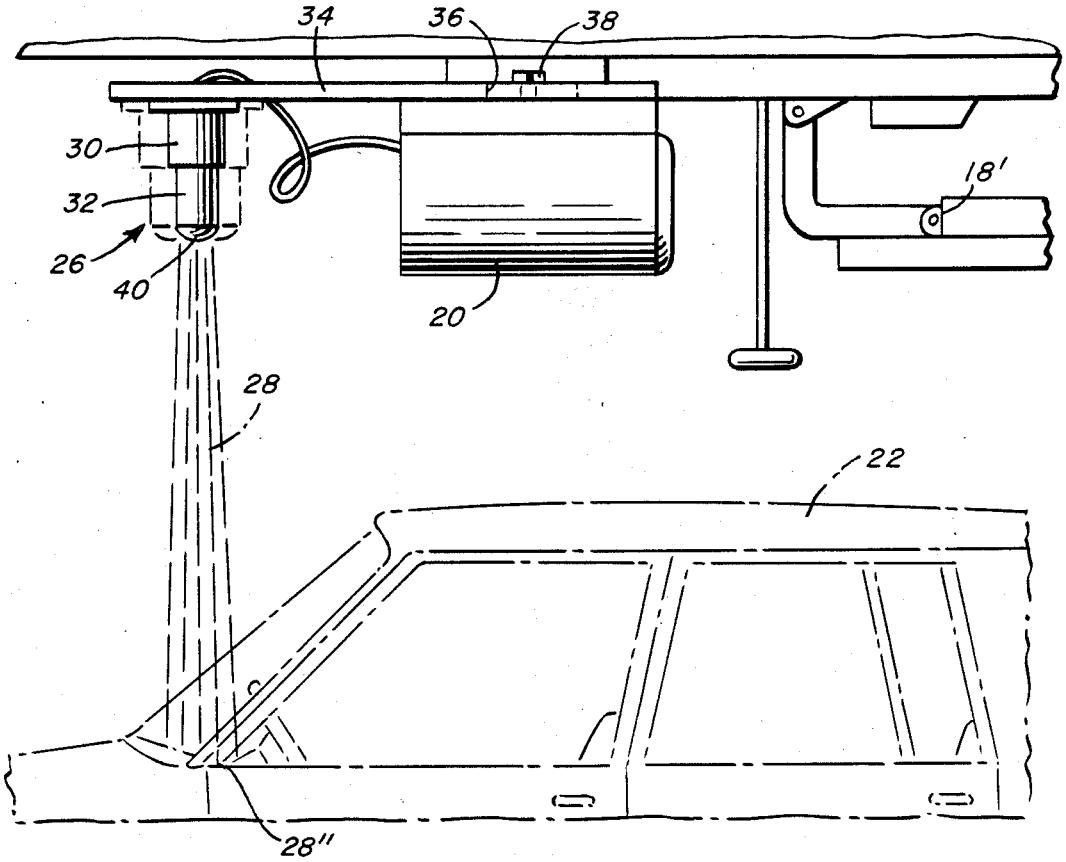
FIG. 2 is an enlarged illustration of a portion of the apparatus, method, means and system of FIG. 1, showing a partial view of an automobile parked therein properly positioned with the garage door fully open.

With reference to FIG. 2, the signal or indicator device 26 may, for example, comprise an electric light source 30 and concentrating lens system 32 to define the beam of light 28 as a generally collimated beam. The light 30 may, for example comprise a high-intensity low voltage lamp. A laser light source, or the like, may also be used. The beam of light 28 provides a spot of light 28' on the garage floor 12, if the garage is empty, i.e., no vehicle present or 28'' on the vehicle 22, when present. The signal or indicator device 26 is to be illuminated only when the garage door 18 is in the fully open position so as to provide a clear objective indication thereof. As pointed out more fully herein, the illumination provided by the signal or indicator device 26 also provides an indication of proper parking position of the vehicle 22 by interpretation of the light spot 28'' by the vehicle operator.

To enable the signal or indicator device 26 to be adjusted so as to provide the light spot 28'' where desired in the vehicle 22, the signal or indicator 26 may be mounted on a sliding bracket 34 provided with a slot 36 and selectively secured, as by a bolt 38 with the housing of the garage door operator 20. The final lens 40 of the light concentrating means 32 may also be constructed and arranged so as to glow when illuminated and thereby provide an additional indication that the garage door 18 is fully opened. If desired, the entire means 32 may be constructed to glow when illuminated.

In operation, when the garage door 18 is fully open, the light source 30 is activated and as hereinbefore pointed out, the objective lens 40 thereof may glow. In addition, if there is no vehicle in the garage 10, the spot of light 28' will be projected onto the floor 12 of the garage 10. As a vehicle, such as the automobile 22 is driven into the garage 10, the spot of light 28'' will appear on the hood as the vehicle is driven under the signal or indicator device 26 to intercept the light beam 28 and the spot 28'' will progress along the hood until it shines through the windsheld and onto the dashboard of the vehicle 22. At the time the spot of light 28'' appears at the appropriate spot on the dashboard of the vehicle 22, the operator will know that the vehicle 22 has reached the desired location. The door operator mechanism 20 can then be safely used to lower the garage door 18 to a closed position and contact with the front wall 16 will also be avoided. When it is desired to exit the garage 10 in the vehicle 22, the garage door operator mechanism 20 can be activated to open the garage door 18 and when the spot of light 28'' appears on the dashboard of the vehicle 22, the operator thereof will be assured that the garage door 18 is fully opened and it is safe to exit the garage. The vehicle 22 may also be backed into the garage, if desired, in which case the spot of light 28'' will not appear on the hood but will suddenly appear through the windshield onto the dashboard when the desired parking location is reached.

Figure 3:
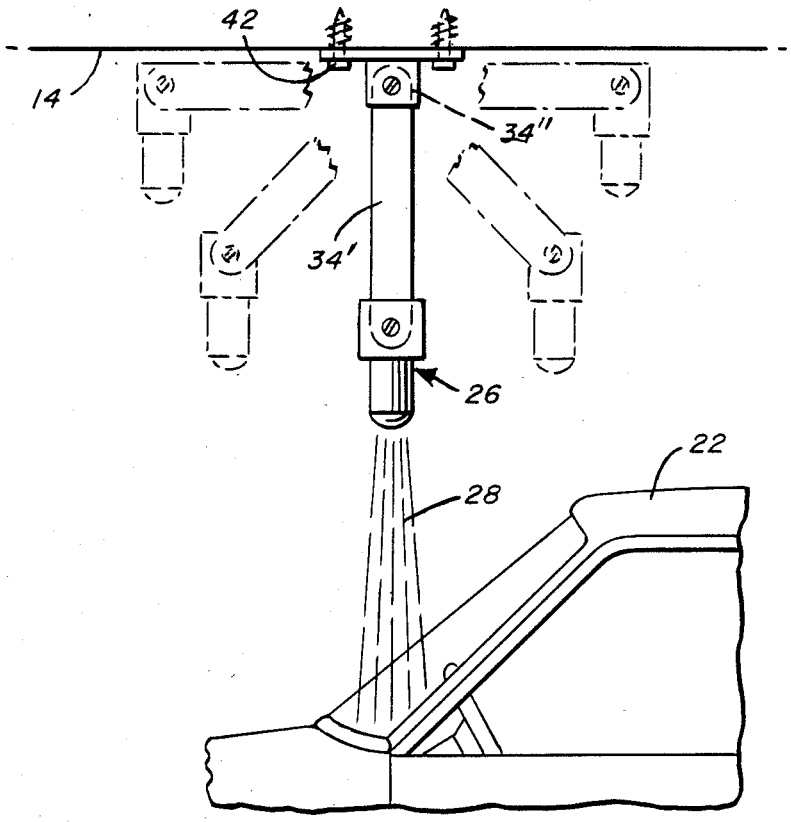
FIG. 3 is an illustration similar to FIG. 2 showing a second embodiment or modification of the present invention.

Referring to FIG. 3, a swinging bracket 34' may be provided to support the signal or indicator device 26. The bracket 34' may be, for example pivotally mounted on a support 34'' at one end portion thereof directly connected to the ceiling 14 of the garage 10, as by bolts 42, with the signaling or indicating device 26 being pivotally carried at the other end portion thereof.

Figure 4:
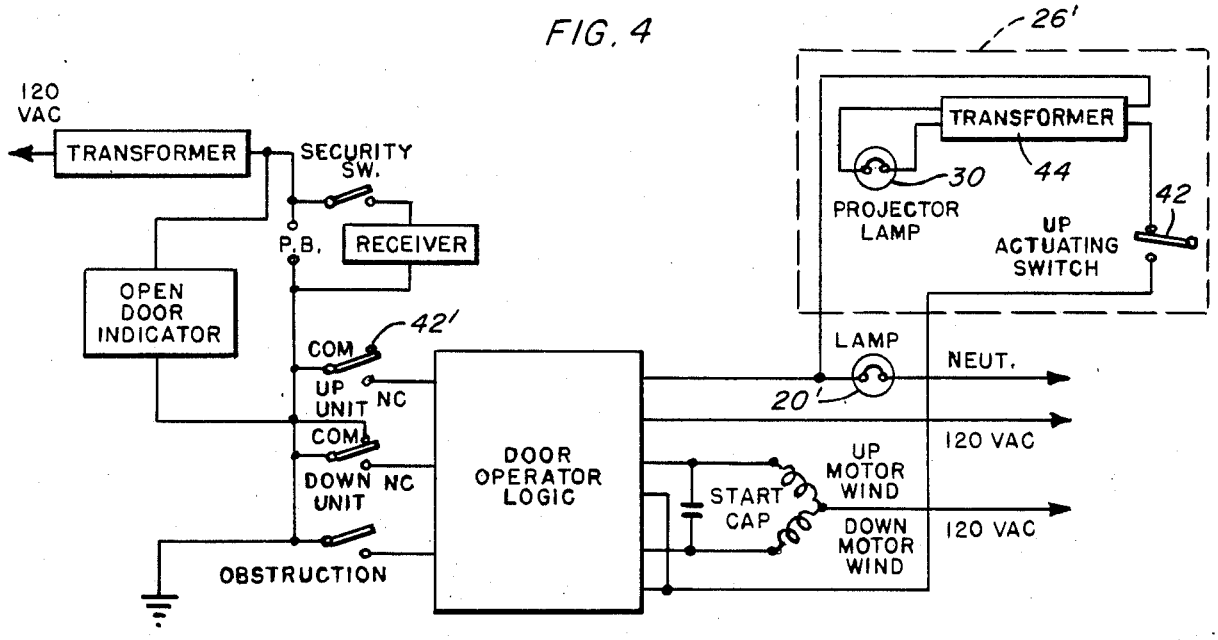
FIG. 4 is a schematic wiring diagram illustrating one embodiment of an electrical schematic useable with the present invention.

With reference now to FIG. 4, there is shown a schematic wiring diagram by which the lamp 30 of the signal or indicator device 26 may be activated. Conventionally, automatic garage door operators are provided with an up-limit switch which stops the drive motor when the door 18 reaches the fully opened position. Such a switch may be a normally closed switch which is held in a closed position by a spring and which is opened by the upper or forward edge 18' of the door 18 when the garage door 18 reaches the fully opened position. Such limit switch may already have a normally open contact pair which may then be used to operate the lamp 30 of the signal or indicator device 26. It may be possible to add such a normally open pair. An inverter device may be used, or a separate limit switch may be added to the door mechanism. A magnetic proximity switch might also be used. Further, a normally closed switch at the lower or forward edge of the door when in the open position and released as the door reaches this position could be used. A normally open switch, moreover, could also be utilized for the operator mechanism with appropriate changes to the door operator mechanism logic, and the signal or indicator device 26 could then be driven therefrom.

Automatic garage door operators further are usually provided with means for turning on an illumination lamp within the garage both when the mechanism is in operation and, through time delay means for a period of time, such as, for example, 90 seconds thereafter to enable the vehicle operator to safely exit the garage after parking the vehicle. The signal or indicator 26 of the present invention can be advantageously energized from such lamp circuit so as to be illuminated after the door stops moving and reaches the fully open position and for the set delay period of the door operator illumination period thereafter. With continued reference to FIG. 4, the circuit 26' of the device 26 may be therefore connected in parallel with the illuminator lamp 20' of the door operator 20. The circuit 26' comrpises a series connected "door up" switch designated by the reference character 42 or a normally open contact 42' on the conventional up-limit switch utilized to control the lamp 30. The lamp 30 may be 110 volt or as shown a lower voltage one, such as a low-voltage, high-intensity lamp supplied by a transformer 44.

In accordance with the present invention, therefore, to enter, the operating mechanism 20 is actuated. When the garage door is fully opened the signal or indicator light 30 will come on. The spot of light 28' will appear on the garage floor. The lens may glow and the driver can easily see it when energized. At that exact instant the driver may proceed to enter the garage. As the driver proceeds into the garage and nears the selected parking position, an intense spot of light 28'' or other image will be visible on the hood of the car as the car hood intercepts the light beam 28. When the car reaches the proper location the intense spot 28'' will be located at the edge of the padded dash. To leave the garage, the driver enters the car, actuates the door operator 20 and waits until the intense spot of light 28' flashes onto the dash. At that exact instant it is safe to exit the garage.

What is claimed is:

1. A vehicle positioning and signalling system for informing an operator of the vehicle when the vehicle is in a desired parking position in a garage and when a garage door is in a safe opened position for movement of the vehicle from the garage, said system comprising, (a) an electric motor-operated garage door operator, (b) an electric light source mounted in the garage and adapted when actuated to project a concentrated beam of light generally downwardly, said light source being electronically connected to said electric motor-operated garage door operator, (c) means for actuating said light source only when said door is in a fully opened position, and (d) a light target on said vehicle at a predetermined spot thereon so that when the beam of light strikes said target, the vehicle will be in the proper parked position within the garage with the door fully opened.

2. A vehicle positioning and signalling system as defined in claim 1, and including means for mounting said light source proximate to said garage door operator and adjustably positioned relative thereto.

3. Vehicle positioning and signaling system defined in claim 2 wherein said mounting means comprises a slidable support attached to at least one of either the door operator or the garage ceiling.

4. A vehicle positioning and signalling system as defined in claim 1, and further comprising mounting means for said light source including a bracket pivotally mounted at one end on a support plate affixed to either said garage ceiling or said garage door operator, said light source being pivotally connected to the other end of said bracket.

5. A vehicle positioning and signalling system as defined in claim 1, wherein said light target is the vehicle dashboard top surface.

* * * * *